US007965955B2

(12) United States Patent
Takahashi et al.

(10) Patent No.: US 7,965,955 B2
(45) Date of Patent: Jun. 21, 2011

(54) IMAGE FORMING APPARATUS

(75) Inventors: Keita Takahashi, Abiko (JP); Akihito Mori, Toride (JP); Nobuo Sekiguchi, Moriya (JP); Tadaaki Saida, Kashiwa (JP); Satoshi Okawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 11/773,229

(22) Filed: Jul. 3, 2007

(65) Prior Publication Data

US 2008/0008484 A1 Jan. 10, 2008

(30) Foreign Application Priority Data

Jul. 10, 2006 (JP) ..... 2006-189245

(51) Int. Cl.
*G03G 15/20* (2006.01)

(52) U.S. Cl. ..... 399/69; 399/45; 399/82; 399/329

(58) Field of Classification Search ..... 399/45, 399/67, 69, 70, 81, 82, 329
See application file for complete search history.

(56) References Cited

U.S. PATENT DOCUMENTS

| | | | | |
|---|---|---|---|---|
| 5,321,481 | A * | 6/1994 | Mathers | 399/69 |
| 6,674,978 | B1 * | 1/2004 | Suzuki et al. | 399/67 |
| 2005/0220467 | A1 * | 10/2005 | Takahashi et al. | 399/45 |
| 2008/0013977 | A1 | 1/2008 | Takahashi et al. | |

FOREIGN PATENT DOCUMENTS

| | | | |
|---|---|---|---|
| CN | 1677273 | A | 10/2005 |
| JP | 61-132972 | A | 6/1986 |
| JP | 11-194647 | A | 7/1999 |
| JP | 2006-064919 | A | 3/2006 |

* cited by examiner

*Primary Examiner* — David P Porta
*Assistant Examiner* — Benjamin Schmitt
(74) *Attorney, Agent, or Firm* — Canon U.S.A., Inc. I.P. Division

(57) ABSTRACT

An image forming apparatus is operable in a speed priority mode in which a temperature range that permits a fixing operation via a pressure belt is wide and an image-quality priority mode in which a temperature range that permits a fixing operation via the pressure belt is narrow. A user interface of the image forming apparatus is configured to enable an operator to select the speed priority mode or the image-quality priority mode for a coated paper.

9 Claims, 13 Drawing Sheets

IMAGE FORMING APPARATUS

BACKGROUND OF THE INVENTION

1. Field of the Invention

The present invention relates to an electrophotographic image forming apparatus that forms an image on a recording material, for example, a copying machine, a printer, or a facsimile machine.

2. Description of the Related Art

In electrophotographic image forming apparatuses, a toner formed on a recording material is fixed as a permanent image by a fixing device.

Among various types of fixing devices, a belt fixing device using a belt has attracted attention as a device that meets a recent demand to increase the image forming speed. This type of fixing device is disclosed in Japanese Patent Laid-Open No. 61-132972.

In this belt fixing device, the length of a fixing nip in the traveling direction of a recording material can be increased by the use of the belt, and more heat can be applied to a recording material on which an unfixed toner image is formed than before. That is, the belt fixing device has a great advantage in its capability of applying a sufficient amount of heat to the recording material even when the image forming speed, in other words, the conveying speed of the recording material increases.

When a highly glossy resin coated paper in which a paper base material is coated with acrylic resin or polyolefin resin (hereinafter referred to as coated paper) is used as a recording material, an image defect that partially raises the coated paper (hereinafter referred to as a blister) sometimes occurs.

A blister seems to occur for the following reason. That is, when excessive heat is applied from the belt to the back side of coated paper, moisture in the base material evaporates and the volume of the coated paper increases. The vapor is intensively radiated from a thin portion or a vacancy of the coating layer. When this phenomenon is marked, a part of the coating layer is sometimes torn.

Accordingly, in a fixing device disclosed in Japanese Patent Laid-Open No. 11-194647, a belt is separated from a fixing roller during standby so that the increase in temperature of the belt is prevented and excessive heat is not applied from the belt to the back side of coated paper.

However, it is difficult to separate the belt from the fixing roller during a continuous copying operation, and in addition, the length of the fixing nip is increased. Therefore, the temperature of the belt increases with the progress of the continuous copying operation.

In the above-described known belt fixing device, in order to increase image productivity, an image forming job is performed immediately after the completion of the previous image forming job, although the temperature of the belt has increased during the previous image forming job.

That is, even when coated paper is used in the image forming job subsequent to the previous image forming job, priority is given to image productivity. Therefore, there is room for improvement in the image quality.

In the market for electrophotographic apparatuses, operators that give priority to image productivity and operators that give priority to image quality are mixed.

However, since known belt fixing devices are intended to give priority to image productivity, they can satisfy the operators that give priority to image productivity, but cannot satisfy the operators that give priority to image quality.

According to the image forming circumstances, an operator sometimes gives priority to image quality, and sometimes gives priority to image productivity. The known belt fixing devices do not meet these various demands of the operators.

SUMMARY OF THE INVENTION

An embodiment of the present invention provides an image forming apparatus that can accommodate the above-described various image forming preferences of operators.

An image forming apparatus according to an aspect of the present invention includes an image forming device configured to form a toner image on a plurality of types of recording material; an operating panel operable by an operator so as to set one of at least two different image forming modes for one type of recording material; and a controller configured to control the image forming device in accordance with the image forming mode set via the operating panel.

Further features of the present invention will become apparent from the following description of exemplary embodiments with reference to the attached drawings.

DESCRIPTION OF THE EMBODIMENTS

Embodiments of the present invention will be specifically described below. It should be noted that various structures described in the following can be altered to other known structures, unless otherwise specified.

Image Forming Section

Figure 2:
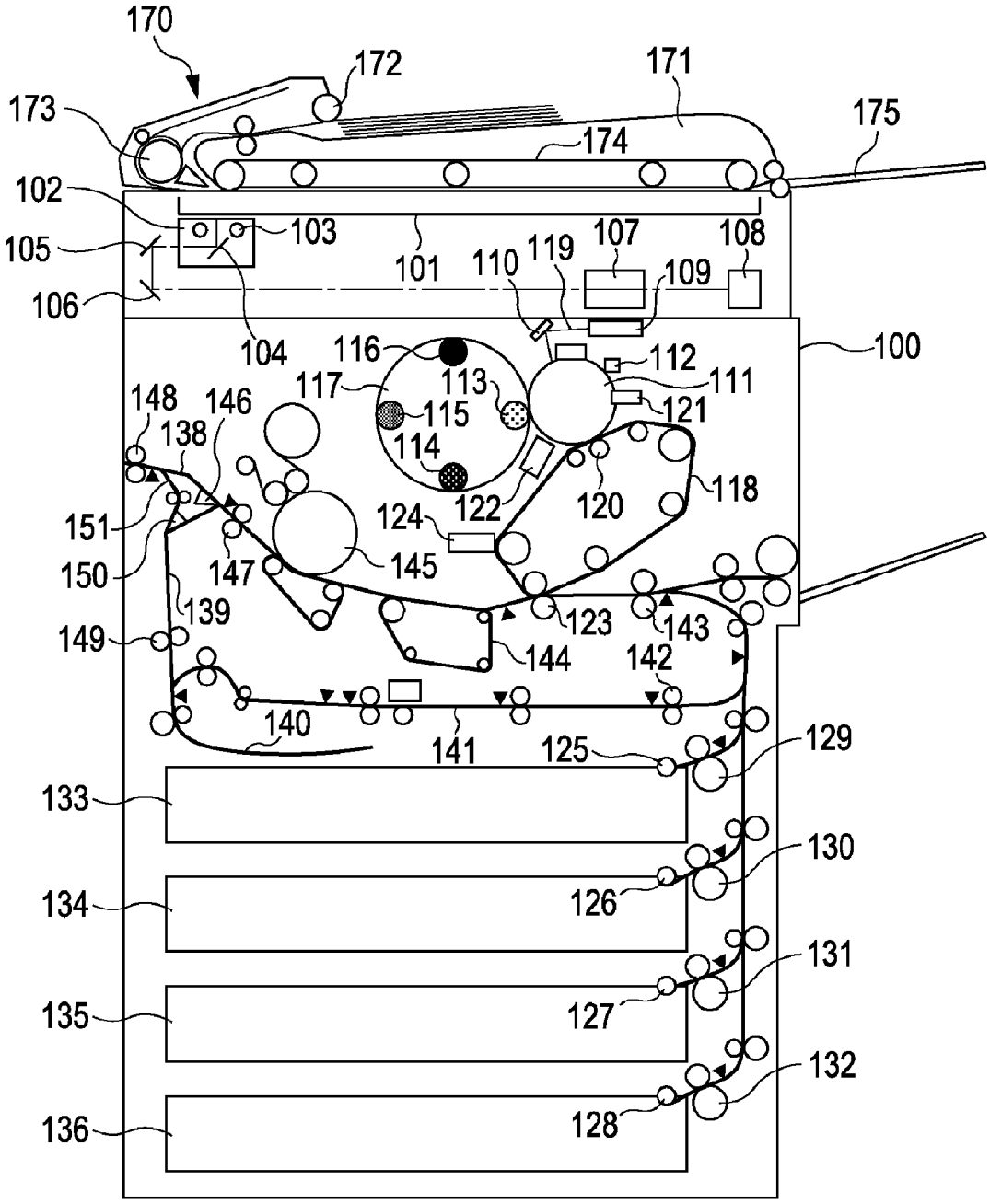
FIG. 2 is a schematic cross-sectional view of an image forming apparatus according to an exemplary embodiment.

FIG. 2 is a schematic view showing the overall configuration of an image forming apparatus 100 according to an embodiment of the present invention. First, a description will be given of an image forming section serving as an image forming device that forms a toner image on a recording material. A toner image formed on a recording material is fixed by being heated with a fixing device serving as an image heating device. The image forming apparatus 100 can form a toner image on various types of recording materials such as plain paper, thick paper, and coated paper, as will be described below.

Referring to FIG. 2, the image forming apparatus 100 includes a platen glass 101 serving as a document table, and a scanner 102. The scanner 102 includes a document illumination lamp 103 and a scanning mirror 104, and is scanned by a motor (not shown) so as to reciprocate in a predetermined direction. During the reciprocating scanning motion of the scanner 102, light reflected from a document passes through a lens 107 via scanning mirrors 104 to 106, so that an image of the document is focused on an image sensor (CCD sensor) 108.

An automatic document feeder (hereinafter referred to as an ADF) 170 automatically feeds a document to a position where the document can be read by the scanner 102. The ADF 170 includes a document tray 171 on which a maximum of one hundred documents can be stacked. A document supply roller 172 supplies the documents in the ADF 170. A document reversing roller 173 allows both sides of the document supplied by the document supply roller 172 to be read. A document conveying belt 174 conveys the document supplied from the document supply roller 172 or the document reversing roller 173. Specifically, the document conveying belt 174 is controlled so as to stop the document conveyed onto the platen glass 101 at a reading position, to return the document to the document reversing roller 173 when reading the back side of the document, and to eject the document to a document output tray 175. Similarly to the document tray 171, a maximum of one hundred documents can be stacked on the document output tray 175.

An image exposure unit 109 includes a laser, a polygonal mirror, and so on. The image exposure unit 109 applies laser light 119, which is modulated on the basis of image signals converted into electric signals by the imager sensor 108 and subjected to a below-described predetermined image processing, onto a photosensitive drum 111 serving as an image bearing member via a mirror 110. An electrostatic latent image corresponding to a document image is formed by the laser light thus applied on the photosensitive drum 111.

Various processing devices that will be described below are arranged around the photosensitive drum 111. The processing devices include a pre-exposure lamp 121 serving as a discharging unit that removes residual charges on the photosensitive drum 111, and a primary charger 112 serving as a charging unit that uniformly charges a surface of the photosensitive drum 111 at a predetermined potential. The above-described image exposure unit 109 applies the laser light 119 onto the surface of the photosensitive drum 111 charged by the primary charger 112.

Developing devices 113 to 116 respectively store yellow toner, magenta toner, cyan toner, and black toner with which an electrostatic latent image formed on the photosensitive drum 111 by the laser light 119 is developed. The developing devices 113 to 116 are mounted in a developing rotary unit 117, and a desired one of the developing devices 113 to 116 is moved to a developing section on the photosensitive drum 111 by the developing rotary unit 117.

A primary transfer roller 120 serves as a primary transfer member that primarily transfers a toner image formed on the photosensitive drum 111 onto an intermediate transfer member 118. A secondary transfer roller 123 serves as a secondary transfer member that secondarily transfers color toner images, which are transferred on the intermediate transfer member 118, together onto the recording material.

A cleaner 122 serving as a cleaning member for removing residual toner is provided outside the intermediate transfer member 118.

Image Forming Sequence of Image Forming Section

An image forming sequence of the above-described image forming section will now be described.

The photosensitive drum 111 is rotated by the motor (not shown). After the photosensitive drum 111 is charged at a predetermined potential by the primary charger 112, the laser light 119 is applied from the image exposure unit 109 onto the photosensitive drum 111 while changing the angle of application by a folding mirror 119, thus forming an electrostatic latent image on the photosensitive drum 111. The developing device 113 for the first color is moved into contact with the photosensitive drum 111 by the developing rotary unit 117, and toner in the developing device 113 is electrostatically attracted onto the electrostatic latent image so as to form a toner image.

In order to form a full-color image with the four developing devices 113 to 116 provided in the developing rotary unit 117, the developing rotary unit 117 is operated so that toner images on the photosensitive drum 111 are primarily transferred onto the intermediate transfer member 118 in a sequential manner.

In this case, formation of electrostatic latent images is controlled by the image exposure unit 109 so that a leading edge of an image of the first color primarily transferred on the intermediate transfer member 118 meets a leading edge of an image of the second color developed on the photosensitive drum 111 at the primary transfer roller 120.

Subsequently, four color images primarily transferred on the intermediate transfer member 118 are secondarily transferred together onto the recording material.

A first sheet supply cassette 133, a second sheet supply cassette 134, a third sheet supply cassette 135, and a fourth sheet supply cassette 136 store recording materials. The recording materials stored in the sheet supply cassettes 133, 134, 135, and 136 are fed by pickup rollers 125, 126, 127, and 128, respectively.

The recording materials are conveyed by sheet feeding rollers 129, 130, 131, and 132 toward registration rollers 143 that stay still while nipping the recording material. The registration rollers 143 start to convey the recording material in synchronization with the above-described secondary transfer.

The recording material on which the toner images have been secondarily transferred is conveyed by a conveying belt 144 toward a fixing device 145.

Some toner is not transferred on the recording material by the secondary transfer roller 123, and remains on the intermediate transfer member 118. A cleaner 124 cleans the intermediate transfer member 118 of the residual toner. The cleaner 124 is movable into contact with and away from the intermediate transfer member 118. When the toner images pass during primary transfer before secondary transfer, the cleaner 124 is separated from the intermediate transfer member 118.

After primary transfer, some toner sometimes remains on the photosensitive drum 111. In this case, the photosensitive drum 111 is cleaned by a cleaner 122. Subsequently, charges remaining on the photosensitive drum 111 are removed by the pre-exposure lamp 121.

The fixing device 145 fixes an unfixed toner image on the recording material by heat and pressure. Then, the recording material is ejected out of the image recording apparatus 100 by inner output rollers 147 and outer output rollers 148.

A sheet output flapper 146 switches the path of the recording material between an output path 138 and a reversing path 139. During two-sided recording (two-sided copying) for forming an image on each side of the recording material, the sheet output flapper 146 is controlled to be turned up. As a result, the recording material conveyed from the inner output rollers 147 is delivered from the output path 138 into the reversing path 139. Subsequently, the recording material is conveyed in reverse to a reverse conveying path 140 for two-sided recording. Consequently, the recording material is led to a refeeding path 141 while being turned upside down. Refeeding rollers 142 refeed the recording material to the image forming section.

The outer output rollers 148 are provided near the sheet output flapper 146, and eject the recording material out of the image forming apparatus 100 after the path of the recording material is switched to the output path 138 by the sheet output flapper 146. In order to reverse and eject the recording material from the image forming apparatus 100, the sheet output flapper 146 is turned up, and the recording material is conveyed into the reversing path 139 by reversing rollers 149 so that a rear edge of the recording material passes through a reversing flapper 150. Then, the reversing rollers 149 are rotated in reverse, so that the recording material is turned upside down, and is conveyed to the output rollers 148 via a reversing output path 151.

Operating Panel

Figure 3:
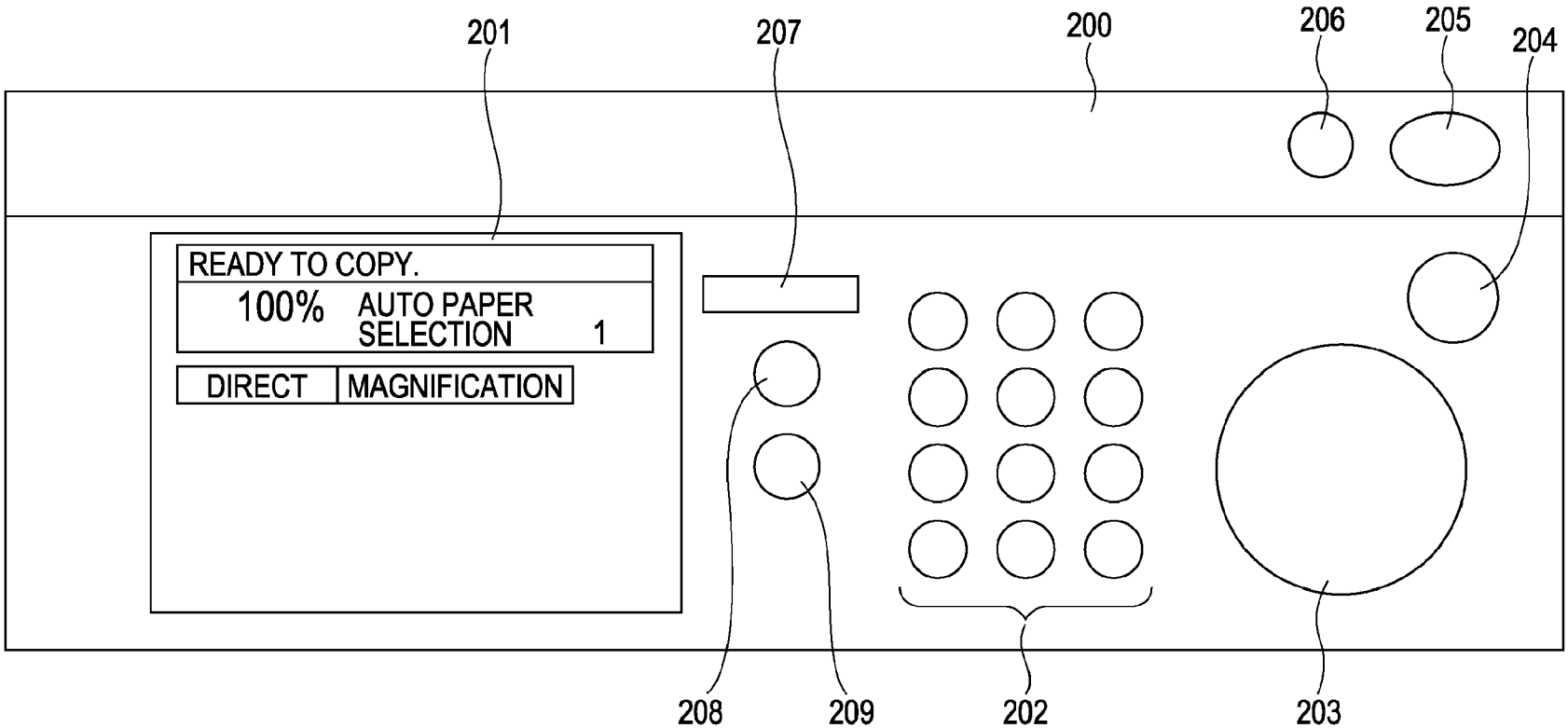
FIG. 3 is a general view of an operating panel of the image forming apparatus according to an embodiment.

FIG. 3 shows an operating panel 200 serving as a setting unit included in a circuit configuration of the image forming apparatus 100 that will be described below with reference to FIG. 4. The operating panel 200 includes an LCD (liquid crystal display) serving as a touch panel display that displays the setting (selection) and state of an image forming mode of the image forming apparatus 100. The operating panel 200 is also referred to as a user interface.

Keys 202 include ten keys for inputting numerals 0 to 9, and clear keys for returning the input to the default.

An operator mode key 209 is used to select a screen on which defaults of functions of the image forming apparatus 100 are set. More specifically, the selected screen includes keys that allow the operator to arbitrarily select adjustment items, such as gradation correction, and keys used to set various network settings such as an IP (internet protocol) address. The selected screen also includes a key (button) used to select/set an image forming mode for coated paper that will be described below.

A start key 203 is pressed to carry out a copy function and a scanning function.

A stop key 204 is pressed to stop jobs such as copying, printing, and scanning.

A soft power key 205 is used to power off loads, such as a motor, in the image forming apparatus 100 while a CPU and a network remain active.

A power-saving mode key 206 is pressed by the operator to save power by setting the controlled temperature of the fixing device 145 to be rather low.

A reset key 207 is used to reset various pieces of information set by means of the ten keys 202 to the defaults.

A guide key 208 is used to display a screen for explaining the copy, printing, and scanning functions set on the LCD 201, and operator modes displayed, set, and carried out by means of the operator mode key 209.

The operating panel 200 allows the operator to input instructions and make various selections relating to operations of the image forming apparatus 100. While the operating panel 200 is effective when the image forming apparatus 100 is used as a copying machine, settings can be made through the following remote control section when the image forming apparatus 100 is used as a printer.

Mode Setting from External Apparatus

Figure 13:
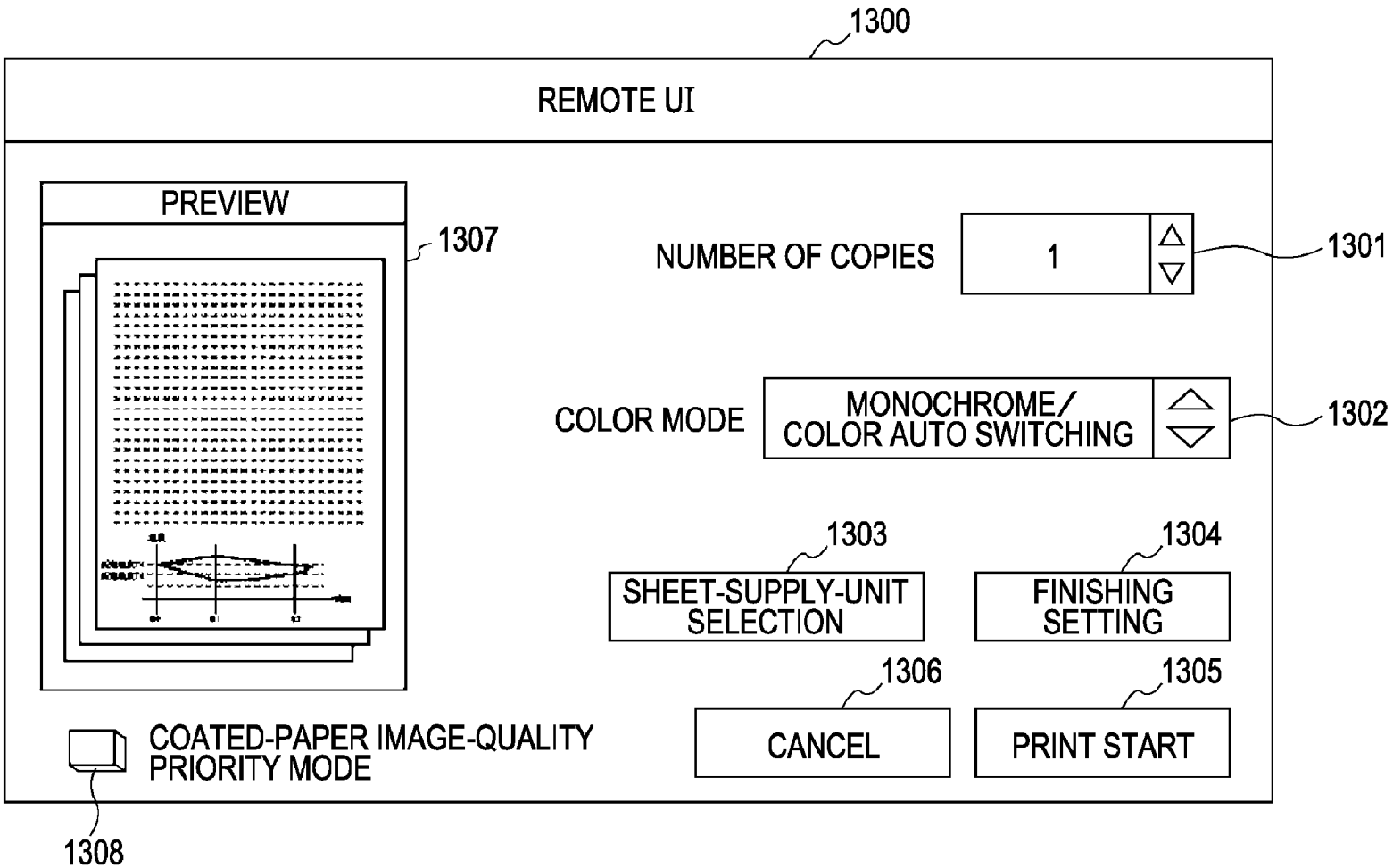
FIG. 13 is a general view of a print setting screen (remote UI) displayed on a host computer connected to the image forming apparatus according to an embodiment.

FIG. 13 shows a print setting screen (hereinafter referred to as a remote UI (user interface)) 1300 displayed on a monitor connected to a host computer that is connected to the image forming apparatus 100 via a LAN cable. That is, the operator can set the type of the recording material and the coated-paper image forming mode on the remote UI 1300.

The remote UI 1300 informs the image forming apparatus 100 of a print job. A window 1301 is used to set the number of copies. A window 1302 is used to select a monochrome mode or a color mode. A window 1303 is used to select the sheet supply unit. A window 1304 is used to set a post processing mode such as stapling and sorting. An image-quality priority mode selection button 1308 is available when coated paper is selected. A window 1307 displays a print preview in accordance with the above-described settings.

After making the above settings, the operator presses a print start button 1305, and the input operation of the operator is completed. When the print start button 1305 is pressed, the contents of an image forming job are sent to a remote controller 320 of the image forming apparatus 100 via a network cable.

The remote controller 320 receives the set information from a host computer, such as a PC, that can communicate with the image forming apparatus 100 via a network cable. That is, the remote controller 320 is an alternative setting unit to the above-described operating panel 200 when the image forming apparatus 100 is used as a printer. The remote controller 320 transmits information (signals) sent from the external apparatus, such as the host computer, to a job controller 301.

A wireless communication unit that can perform wireless communication with the external apparatus, such as the host computer, can be provided in the image forming apparatus 100. In this case, the remote controller 320 receives information from the external apparatus in a wireless manner, and transmits the information to the job controller 301.

Control Circuit Configuration

Figure 4:
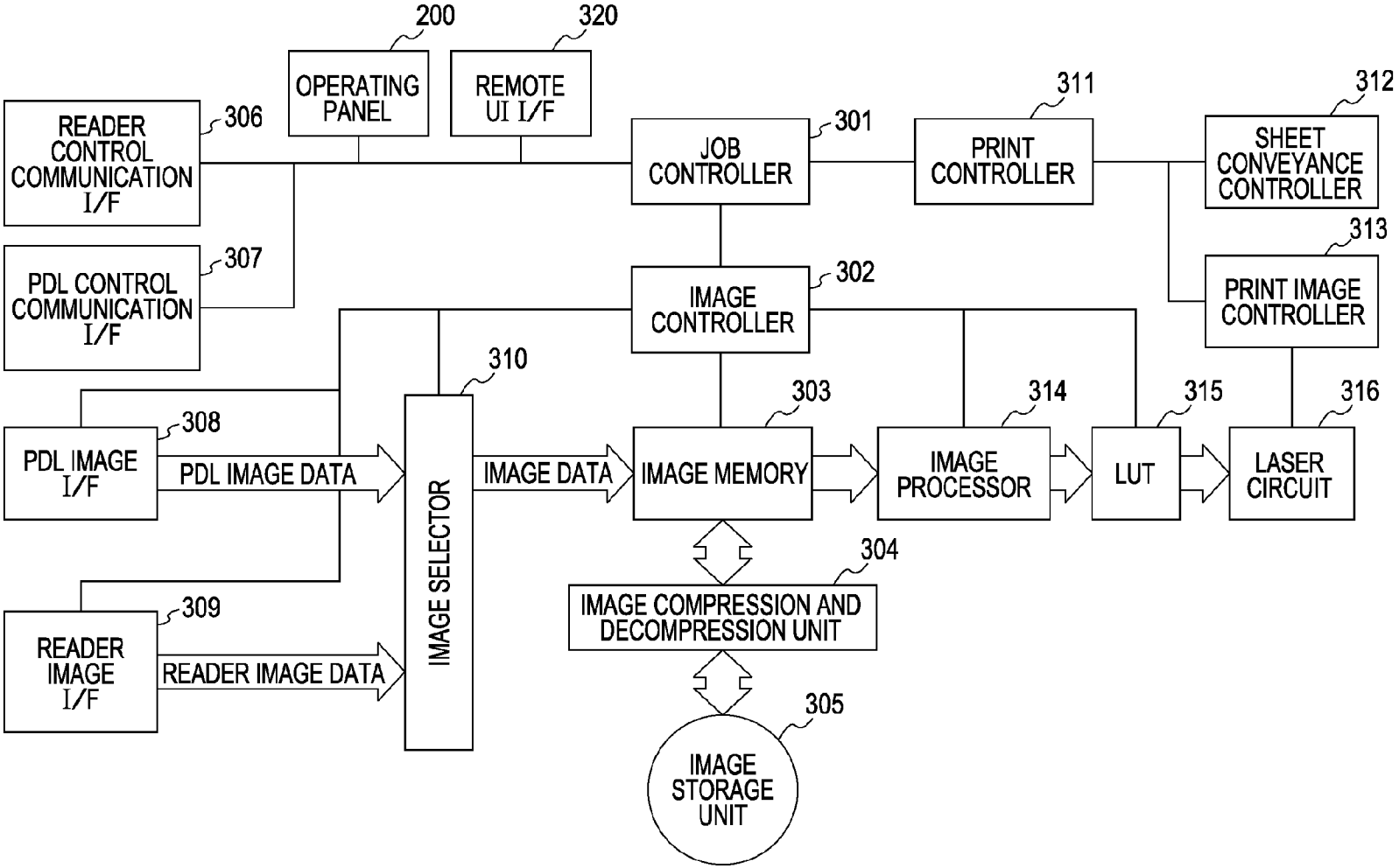
FIG. 4 is a block diagram of a control circuit of the image forming apparatus according to an embodiment.

FIG. 4 is a block diagram showing a circuit configuration for controlling the devices in the image forming apparatus 100. In FIG. 4, reference numeral 200 denotes the above-described operating panel.

The operating panel 200 is connected to a job controller 301 serving as a circuit including a ROM that stores a program for controlling the image forming apparatus 100, a RAM that expands the program, and a CPU that executes the program. That is, the contents set on the operating panel 200 are transmitted to the job controller 301.

The job controller 301 generates a copy job and a scan job on the basis of information indicated by the transmitted signals.

The job controller 301 is connected to a reader control communication I/F 306 serving as a communication interface with a CPU circuit that controls the reader 101 for reading a document image. The job controller 301 is also connected to a PDL control communication I/F 307 serving as a communication interface with a CPU circuit of a PDL image controller that expands PDL image data transmitted from the external apparatus, such as the host computer, into bitmapped images. The job controller 301 is also connected to an image controller 302 that controls image data on a PDL image and a reader image to be transmitted to the image forming apparatus 100 shown in FIG. 2. The job controller 301 is also connected to a print controller 311 that forms an image by controlling the driving of the loads. That is, the job controller 301 controls the entire image forming apparatus 100.

The image controller 302 is a circuit that makes settings for the circuits related to images according to a job generated by the job controller 301.

In an embodiment, the image controller 302 controls the operation of an image selector 310. Specifically, the image selector 310 selects PDL image data sent from a PDL image I/F 308 or reader image data sent from a reader image I/F 309 so as to store the data in an image memory 303 formed of a volatile memory. That is, the image controller 302 determines which image data is stored in the image memory 303, and determines which region of the image memory 303 stores the image data.

The image controller 302 also makes settings for an image storage unit 305 formed of a nonvolatile memory, such as an HDD, and makes settings so as to compress and transmit bitmapped image data from the image memory 303 into the image storage unit 305. Moreover, the image controller 302 makes settings for an image compression and decompression unit 304 that decompresses compressed image data from the image storage unit 305 and returns the decompressed data to the image memory 305. Further, the image controller 302 reads color image data from the image memory 303 in order to form an image according to the image data, and performs predetermined image processing in an image processor 314.

The print controller 311 receives data on color images finally sent from a print image controller (color separator) 313 according to the settings of the image controller 302 made in accordance with the job generated by the job controller 301. The print controller 311 instructs the print image controller 313 to transmit information to a laser circuit 316 serving as an image exposure unit.

According to the instructions from the print controller 311, the print image controller 313 sets an LUT (look up table) 315 in which the sensitivity characteristic of the photosensitive drum 111 is reflected in the image data. The LUT 315 is used to cope with a case in which a desired image density is not obtained, for example, because of the changes in the sensitivity characteristic of the photosensitive drum 111, the laser light exposure, and the amount of charges from the primary charger 112. That is, the LUT 315 also serves to change the image density to a desired density in accordance with the input image data. Image data for the colors is output to the laser circuit 316 via the LUT 315, and latent images corresponding to the colors are formed on the photosensitive drum 111. The color latent images are developed into visual toner images by the developing devices 113 to 116.

Further, the print controller 311 feeds recording materials from the sheet cassettes 130 to 133 to a sheet conveyance controller 312 in synchronization with the print image controller 313.

Fixing Device

A description will now be given of the configuration of the fixing device 145 serving as the image heating device.

Figure 1:
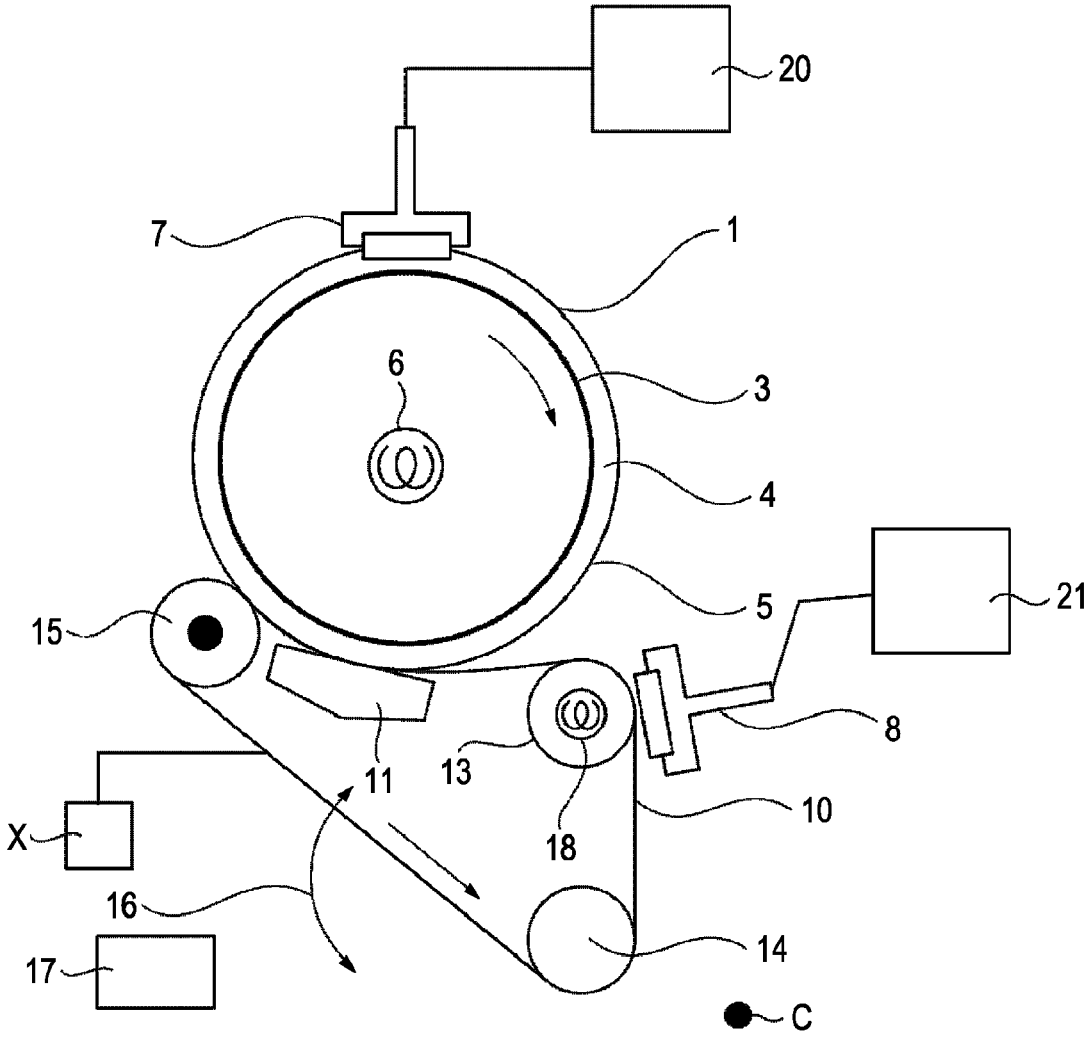
FIG. 1 is a schematic cross-sectional view of a fixing device included in an image forming apparatus according to an exemplary embodiment of the present invention.

FIG. 1 is a schematic cross-sectional view of the fixing device 145 included in the image forming apparatus according to an embodiment of the present invention. The fixing device 145 includes a fixing roller 1 serving as a heating rotary member. In the fixing roller 1, a hollow metal core 3 is coated with an elastic layer 4 formed of, for example, a silicon rubber, and the elastic layer 4 is coated with a fluorine coating layer 5 serving as a release layer. A halogen lamp 6 serving as a heater is provided in the fixing roller 1.

A thermistor 7 serving as a detector is a sensor that detects the temperature of the fixing roller 1, and is provided in contact with a surface of the fixing roller 1. The thermistor 7 transmits the detected temperature as electrical signals to a temperature adjusting circuit 20 serving as a current supply controller. The temperature adjusting circuit 20 controls the current supply to the halogen lamp 6, that is, controls lighting of the halogen lamp 6 so that the temperature of the surface of the fixing roller 1 is kept at a preset temperature. The temperature adjusting circuit 20 is provided in the print controller 311 (FIG. 4), and is connected to the thermistor 7 and the halogen lamp 6.

A pressure belt 10 serves as a pressure rotary member (nip forming member). The pressure belt 10 is shaped like an endless belt formed of a heat-resistant resin material such as polyimide. The pressure belt 10 is rotatably and tightly stretched by stretching members 13, 14, and 15.

A contact and separation mechanism X is provided to bring the pressure belt 10 into contact with the fixing roller 1 and to separate the pressure belt 10 from the fixing roller 1. The contact and separation mechanism X allows the pressure belt 10 to pivot about a pivot center C in the direction shown by arrow 16 in FIG. 1. In an embodiment, as will be described below, the controller exerts control so that the pressure belt 10 is separate from the fixing roller 1 in a circumstance in which a fixing operation is not performed, for example, during standby. The controller also exerts control so that the pressure belt 10 is brought into contact with the fixing roller 1 at a predetermined timing in response to the input of a fixing start signal.

A pressure pad 11 is shaped like an aluminum block. The pressure pad 11 presses the pressure belt 10 against the fixing roller 1, thereby forming a fixing nip.

The fixing roller 1 is rotated by a driving device (not shown), and the pressure belt 10 rotates while following the fixing roller 1.

A halogen lamp 18 serves as a heater for heating the pressure belt 10.

A thermistor 8 detects the temperature of the pressure belt 10, and transmits the detected temperature as electrical signals to a temperature adjusting circuit 21 serving as a controller. The temperature adjusting circuit 21 controls the current supply to the halogen lamp 18, that is, controls lighting of the halogen lamp 18 so that the temperature of the surface of the pressure belt 10 is kept at a preset temperature. The temperature adjusting circuit 21 is provided in the print controller 311 (FIG. 4), and is connected to the thermistor 8 and the halogen lamp 18.

Fixing Sequences of Fixing Device

A description will now be given of various fixing sequences (image heating sequences) of the fixing device (image heating device) 145.

When the image forming apparatus 100 is powered on, a warm-up operation is started to increase the temperatures of the fixing roller 1 and the pressure belt 10 to their respective preset temperatures. That is, current supply to the halogen lamps 6 and 18 is started, and the rotation of the pressure belt 10 is also started. In this case, the pressure belt 10 is separate from the fixing roller 1, and the rotation of the fixing roller 1 is stopped during the warm-up operation.

When the temperatures of the fixing roller 1 and the pressure belt 10 reach their respective preset temperatures, a state in which image formation is possible (standby state) is brought about. In an embodiment, the preset temperature of the fixing roller 1 is 160° C., and the preset temperature of the pressure belt 10 is 100° C.

The standby state is maintained when an image formation start signal is not input after the warm-up operation is completed. That is, the lighting of the halogen lamps 6 and 18 is controlled by the temperature adjusting circuits 20 and 21 so as to maintain the preset temperatures of 160° C. and 100° C. in a state in which the fixing roller 1 and the pressure belt 10 are separate from each other. In this case, the pressure belt 10 is rotated so as to avoid variations in temperature.

When an image formation start signal is input from the operating panel 200 or the remote controller 320 in this standby state, the contact and separation mechanism X brings the pressure belt 10 into contact with the fixing roller 1 so as to form a fixing nip. Subsequently, heat and pressure are applied to a recording material conveyed from the image forming section so as to fix an unfixed toner image on the recording material (image heating process). The preset temperatures of the fixing roller 1 and the pressure belt 10 in accordance with the type of the recording material (hereinafter also referred to as the material type) will be described in detail below.

Material Setting

Figure 5:
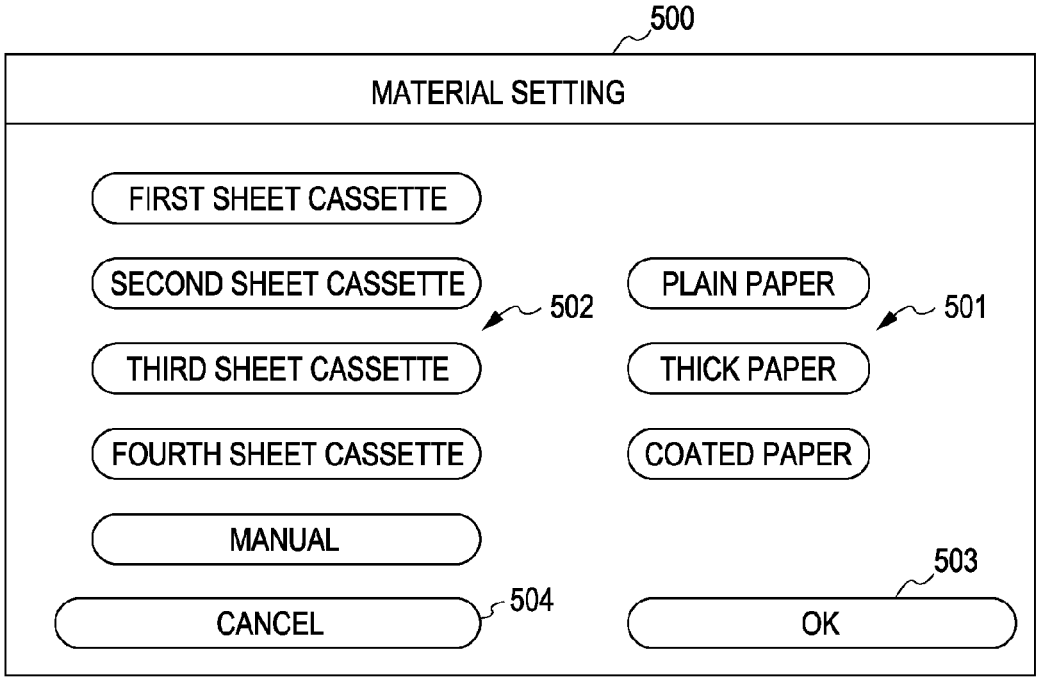
FIG. 5 is a schematic view of a recording material setting screen of the image forming apparatus according to an embodiment.

FIG. 5 shows a material setting screen 500 displayed on the operating panel 200. On the material setting screen 500, the type of a recording material used for image formation is set. In the image forming apparatus 100 according to an embodiment, various types of recording materials can be set in sheet supply units such as sheet supply cassettes (including a manual feed tray). The operator can select a desired sheet supply unit on the material setting screen 500 so that an image is formed on a desired recording material. When the operator sets a recording material on the manual feed tray for image formation, the manual feed tray is selected.

The operator selects a sheet supply unit by pressing any of sheet-supply-unit setting keys 502, and sets/selects the type of the recording material set in the selected sheet supply unit by pressing any of material setting keys 501 corresponding to plain paper, thick paper, and coated paper.

In an embodiment, a recording material having a basis weight of less than 106 g/m$^2$ is referred to as plain paper, a recording material having a basis weight of 106 g/m$^2$ or more is referred to as thick paper, and a recording material in which a paper base is coated with, for example, acrylic resin or polyolefin resin is referred to as coated paper.

It is recommended to select, on the material setting screen 500 of the operating panel 200, plain paper when the recording material has a basis weight of less than 106 g/m$^2$, and thick paper when the recording material has a basis weight of 106 g/m$^2$ or more. When the recording material is coated paper, it is recommended to select coated paper on the material setting screen 500.

After setting the sheet supply unit and the type of the recording material on the material setting screen 500, the operator presses an OK key 503, thus completing the material setting operation. The operator can cancel the setting operation by pressing a cancel key 504. In this case, for example, the preset default type of the recording material (e.g., plain paper) is automatically selected.

Temperature Setting Procedure in Accordance with Material Type

Figure 6:
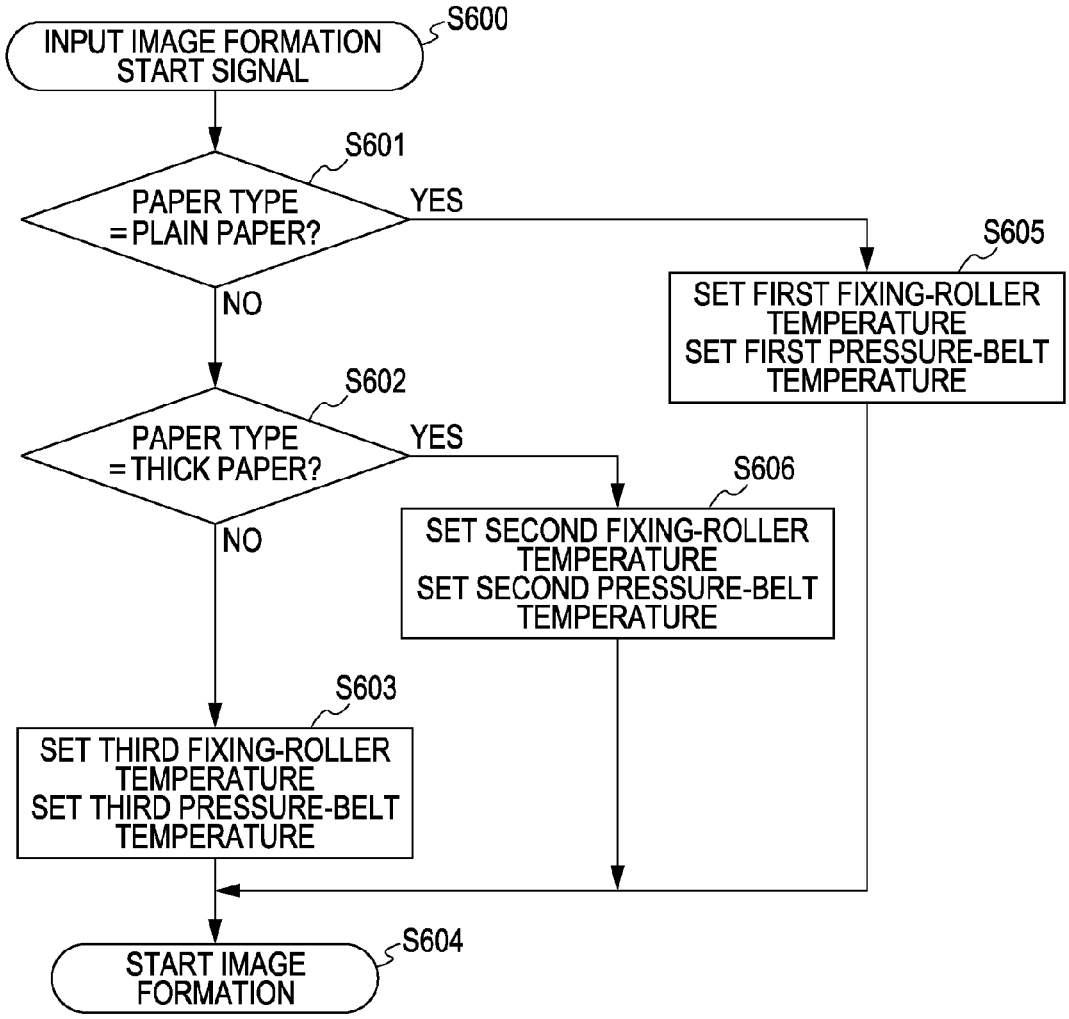
FIG. 6 is a flowchart showing a procedure for setting the temperatures in accordance with the type of the recording material according to an embodiment.

Referring to FIG. 6, a description will be given of a procedure for determining preset temperatures (target temperatures) of the fixing roller 1 and the pressure belt 10 in accordance with the type of the recording material selected on the material setting screen 500. Current supply to the halogen lamp 6 for the fixing roller 1 and the halogen lamp 18 for the pressure belt 10 is controlled so that the temperatures of the fixing roller 1 and the pressure belt 10 become equal to (are maintained at) the temperatures determined in the following procedure.

When an image formation start signal is input in Step S600, the type of a recording material used for image formation is checked. The image formation start signal is input by the press of the start key 203 on the operating panel 200 when the image forming apparatus 100 is used as a copying machine, and in response to the transmission of a signal from an external apparatus to the remote controller 320 when the image forming apparatus 100 is used as a printer.

In Step S601, it is determined whether the recording material is plain paper. If so, the preset temperature of the fixing roller 1 is set at a first fixing-roller temperature (Table 1) and the preset temperature of the pressure belt 10 is set at a first pressure-belt temperature (Table 1) in Step S605.

When it is determined in Step S601 that the recording material is not plain paper, it is determined in Step S602 whether the recording material is thick paper. If so, the preset temperature of the fixing roller 1 is set at a second fixing-roller temperature (Table 1) and the preset temperature of the pressure belt 10 is set at a second pressure-belt temperature (Table 1) in Step S606.

When it is determined in Step S602 that the recording material is not thick paper, it is determined that the recording material is coated paper. In Step S603, the preset temperature of the fixing roller 1 is set at a third fixing-roller temperature (Table 1) and the preset temperature of the pressure belt 10 is set at a third pressure-belt temperature (Table 1). The preset temperatures of the fixing roller 1 and the pressure belt 10 according to an embodiment are listed in Table 1.

TABLE 1

| | Temperature (° C.) |
|---|---|
| First fixing-roller temperature | 165 |
| First pressure-belt temperature | 100 |
| Second fixing-roller temperature | 160 |
| Second pressure-belt temperature | 100 |
| Third fixing-roller temperature | 150 |
| Third pressure-belt temperature | 95 |

Setting of Image Forming Mode for Coated Paper

Figure 7:
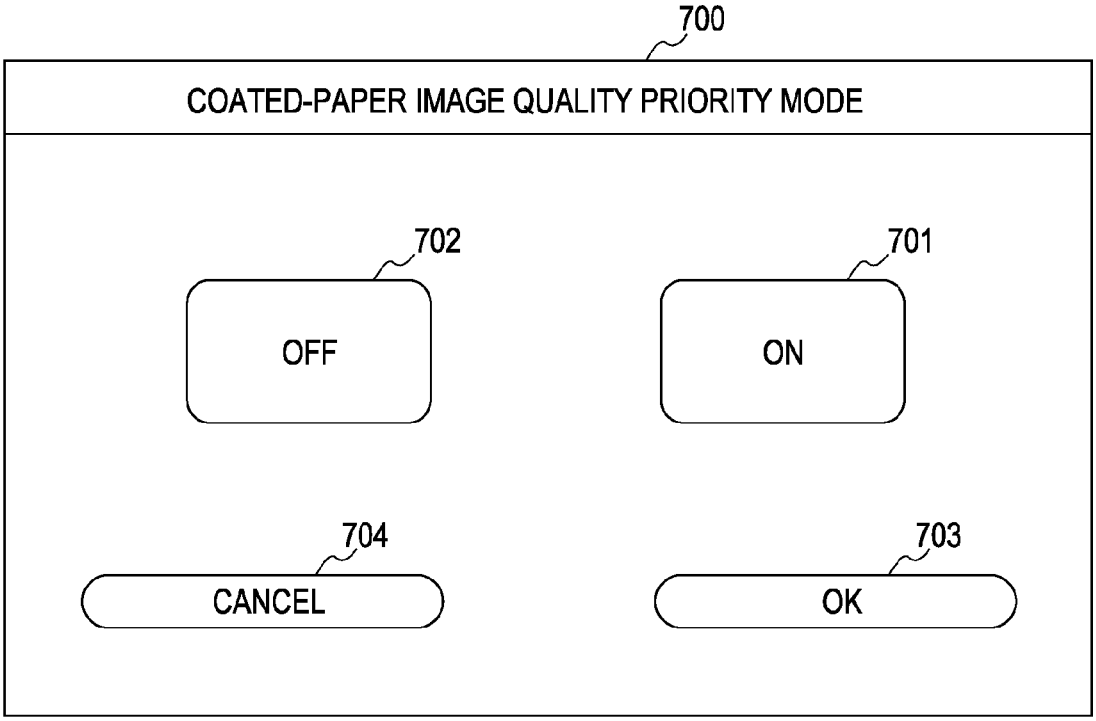
FIG. 7 is a schematic view showing a screen on which an image forming mode for coated paper is set according to an embodiment.

Referring to FIG. 7, a description will be given of an operation of setting/selecting one of a plurality of image forming modes prepared for coated paper.

When the operator mode key 209 on the operating panel 200 is pressed, a screen 700 for setting a coated-paper image-quality priority mode appears on the display 201. This setting screen 700 includes an On key 701 for setting an image-quality priority mode, an Off key 702 for setting a speed priority mode (hereinafter also referred to as productivity priority mode), and an OK key 703 for completing the setting. The setting operation can be cancelled by pressing a cancel key 704. When the setting operation is thus cancelled, the display 201 returns to the normal screen as the default. In an embodiment, in a state in which a setting is not made on the screen 700 for setting a coated-paper image-quality priority mode, the print controller 311 (FIG. 4) automatically selects a speed priority mode (productivity priority mode) that will be described below.

In the speed priority mode (productivity priority mode) (first image forming mode), the image quality is lower than in the above-described image-quality priority mode, but the time taken from when the image formation start signal is input to when the recording material is ejected out of the image forming apparatus 100 is shorter than in the image-quality priority mode. That is, in the speed priority mode, productivity is higher than in the image-quality priority mode. This can meet the operator's demand to quickly check a formed image. In the speed priority mode, the level of image quality is set so as to satisfy normal operators.

In the image-quality priority mode (second image forming mode) prepared for coated paper, the time taken from when the image formation start signal is input to when the recording material is ejected out of the image forming apparatus 100 is longer than in the speed priority mode, but the image quality is higher than in the speed priority mode. This can meet the operator's demand to obtain a higher-quality image.

The image-quality priority mode and the speed priority mode are different in the fixing condition (image heating condition), as will be described below.

Further, when the image-quality priority mode or the speed priority mode is set/selected, image forming sequences that will be described below are performed.

While the image-quality priority mode and the speed priority mode are prepared for coated paper and one of the modes can be selected/set in an embodiment, other different modes may be added. In this case, the operator can select/set one of three or more image forming modes.

In the following description, an "image forming job" refers to an image forming operation (image forming processing) performed in response to the input of one image formation start signal. For example, when one hundred copies of one document are made, an image forming job refers to a series of image forming operations (the first to hundred copies) performed in response to the press of the start key by the operator. In a case in which the image forming apparatus 100 is used as a printer, an image forming job refers to a series of image forming operations performed when the remote controller 320 receives a command signal to obtain one hundred prints.

Relationship Between Temperature of Pressure Belt and Image Quality

Figure 8:
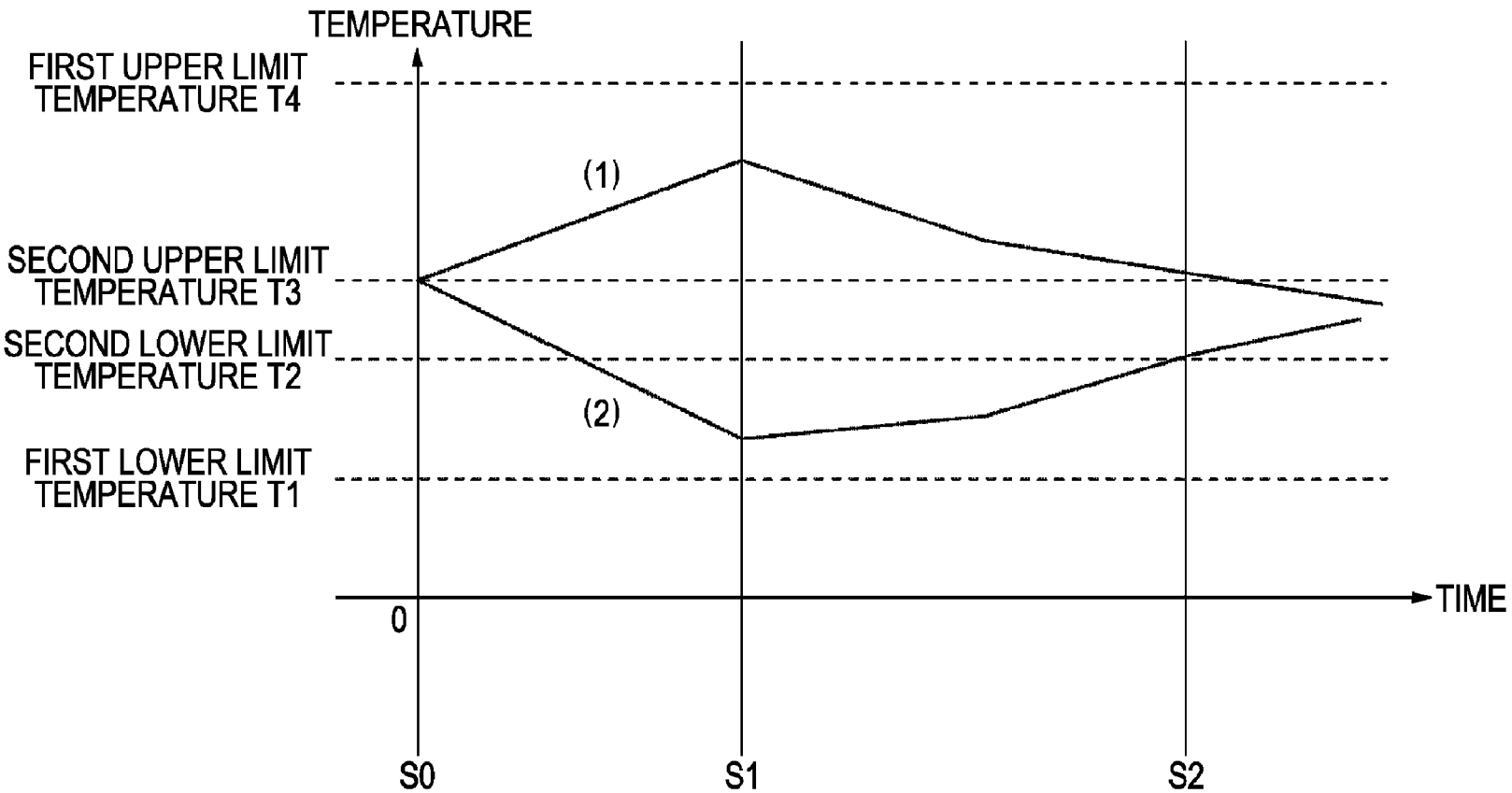
FIG. 8 is a graph showing the temperature changes of a pressure belt according to an embodiment.

The relationship between the temperature of the pressure belt 10 and the image quality will now be described with reference to FIG. 8. FIG. 8 shows two experimental examples (1) and (2) relating to the change in the temperature of the pressure belt 10. In FIG. 8, the vertical axis indicates the temperature, and the horizontal axis indicates the time.

A first lower limit temperature T1 is the lower limit of the temperature that permits a fixing operation (image heating operation). In the illustrated embodiment, the first lower limit temperature T1 is 80° C.

A second lower limit temperature T2 is the lower limit temperature required to prevent an image defect on the low temperature side. In the illustrated embodiment, the second lower limit temperature T2 is 90° C.

A second upper limit temperature T3 is the upper limit temperature required to prevent an image defect on the high temperature side. In the illustrated embodiment, the second upper limit temperature T3 is 100° C.

A first upper limit temperature T4 is the lower limit of the temperature that permits a fixing operation (image heating operation). In the illustrated embodiment, the first upper limit temperature T4 is 160° C.

Unless the image forming apparatus 100 breaks down, the temperature of the pressure belt 10 does not reach the temperatures T1 and T4. If the temperature of the pressure belt 10 reaches the temperature T1 or T4, the image forming job is stopped forcibly. In this case, an error display is performed on the display 201 of the operating panel 200 so as to inform the operator of the error.

FIRST EXPERIMENTAL EXAMPLE

A concrete example of a change in temperature in a first experimental example will be described.

In the first experimental example, an image forming job for performing image formation on coated paper is input (requested) while the temperature of the pressure belt 10 is increasing with the progress (time S0 to time S1) of a job for continuously forming full-color images on a plurality of sheets of plain paper. That is, the first experimental example shows the image formation start timing adopted when the next job for performing image formation on coated paper is set in an image-quality priority mode and a speed priority mode.

First, a job for performing image formation on plain paper is started at a time S0. Since the single photosensitive drum 111 is used in an embodiment, the time interval at which recording materials pass through the fixing device 145 tends to increase when a full color image is formed. Further, since the pressure belt 10 is still in contact with the fixing roller 1 during the image forming job, the temperature of the pressure belt 10 is increased by the fixing roller 1 so as to exceed 100° C. that is the preset temperature (target temperature) for plain paper.

A time S1 in the first experimental example represents a time when the image forming job for plain paper is completed. As described above, an image forming job for coated paper has been requested by the time S1.

When the requested job is selected/set in a speed priority mode, the print controller 311 exerts control so that the image forming job starts just at the time S1 because the temperature of the pressure belt 10 is within a first temperature range of the first lower limit temperature T1 to the first upper limit temperature T4. That is, in the speed priority mode, image formation can be started as long as the temperature of the pressure belt 10 is mote than or equal to the first lower limit temperature T1 and lower than or equal to the first upper limit temperature T4. In this way, the temperature range of the pressure belt 10 that permits fixing (image heating operation) in the speed priority mode is wide. Therefore, image formation can be started without imposing a waiting time on the operator.

In contrast, when the requested job is selected/set in an image-quality priority mode, the print controller 311 delays the start of image formation (standby) because the temperature of the pressure belt 10 is not within a second temperature range of the second lower limit temperature T2 to the second upper limit temperature T3 at the time S1. Then, the print controller 311 exerts control so that image formation is started just at a time S2 when the temperature of the pressure belt 10 is decreased into the second temperature range by cooling. That is, in the image-quality priority mode, image formation can be started as long as the temperature of the pressure belt 10 is more than or equal to the second lower limit temperature T2 and less than or equal to the second upper limit temperature T3. In this way, the temperature range (temperature condition) of the pressure belt 10 that permits fixing in the image-quality priority mode is narrower (more strict) than in the speed priority mode. Therefore, the time needed to start image operation is increased, but it is possible to meet the operator's demand for higher image quality.

SECOND EXPERIMENTAL EXAMPLE

A second experimental example will now be described.

In the second experimental example, an image forming job for performing image formation on coated paper is input (requested) while the temperature of the pressure belt 10 is decreasing with the progress (time S0 to time S1) of a job for continuously monochrome images on a plurality of sheets of plain paper (hereinafter referred to as a monochrome job). Similarly to the above-described first experimental example, the second experimental example shows the image formation start timing adopted when the next job for performing image formation on coated paper is set in an image-quality priority mode and a speed priority mode.

First, a monochrome job for plain paper is started at a time S0. In an embodiment, the productivity of monochrome images is about four times the productivity of full-color images. That is, the time interval at which recording materials pass through the fixing nip is even shorter than in the full-color image forming operation. Since the pressure belt 10 is still in contact with the fixing roller 1 during the image forming job, the temperature of the pressure belt 10 falls below 100° C. that is the preset temperature for plain paper.

A time S1 in the second experimental example shows a time at which the monochrome job for plain paper is completed. As described above, an image forming job for coated paper has been requested by the time S1.

When the requested job is selected/set in a speed priority mode, the print controller 311 exerts control so that image formation starts just at the time S1 because the temperature of the pressure belt 10 is within the first temperature range of T1 to T4. In this way, similarly to the first experimental example, the temperature range (temperature condition) of the pressure belt 10 that permits fixing (image heating operation) in the speed priority mode is wide (easy) in the second experimental example. Therefore, image formation can be started without imposing a waiting time on the operator.

In contrast, when the requested job is selected/set in an image-quality priority mode, the print controller 311 delays the start of image formation (standby) because the temperature of the pressure belt 10 is not within the second temperature range of T2 to T3 at the time S1. Then, the print controller 311 exerts control so that image formation starts just at a time S2 when the temperature of the pressure belt 10 is increased into the second temperature range by heating. In this way, similarly to the first experimental example, the temperature range of the pressure belt 10 that permits fixing in the image-quality priority mode is narrower than in the speed priority mode. Therefore, the time needed to start image formation is slightly long, but it is possible to meet the operator's demand for higher image quality.

While the first lower limit temperature T1 and the second lower limit temperature T2 are different in the above-described examples, they can be equally set to be a temperature that does not cause an image defect on the low temperature side.

While the changes in temperature of the pressure belt 10 have been described with reference to FIG. 8, a detailed description of the change in temperature of the fixing roller 1 is omitted because the change in temperature of the fixing roller 1 is negligible when an image defect, such as a blister, is considered. That is, the temperature of the fixing roller 1 is maintained substantially at the preset temperature by controlling the current supply to the halogen lamp 6, regardless of the passage of recording materials. In order to minimize the change in temperature of the fixing roller 1, an externally heating roller can be provided to heat the fixing roller 1 while being in contact with an outer surface of the fixing roller 1.

Sequences in a speed priority mode and an image-quality priority mode for coated paper will be described in detail below. In an embodiment, these two sequences are controlled by the print controller 311 (FIG. 4).

Sequence in Speed Priority Mode

A sequence in a speed priority mode will be described in detail with reference to FIG. 9.

When an image formation signal (print command) is input in Step S900, the preset temperatures of the fixing roller 1 and the pressure belt 10 are changed in Step S901 in the same sequence as the above-described sequence shown in FIG. 6.

In Step S902, it is determined whether the temperature of the pressure belt 10 is more than or equal to the first lower limit temperature T1. It is also determined whether the temperature of the pressure belt 10 is less than or equal to the first upper limit temperature T4. That is, the output of the thermistor 8 for the pressure belt 10 is checked.

When the temperature of the pressure belt 10 is more than or equal to the first lower limit temperature T1 and less than or equal to the first upper limit temperature T4, in Step S905, image formation is started immediately after the previous image forming job.

When the temperature of the pressure belt 10 is outside the first temperature range of the first lower limit temperature T1 to the first upper limit temperature T4, a standby state is brought about in Step S903 without starting the next image forming job.

When it is determined in Step S902 that the temperature of the pressure belt 10 is less than the first lower limit temperature T1, the pressure belt 10 is heated during a standby state before an image forming job is started. That is, the pressure belt 10 is rotated while applying a current to the halogen lamp 18. In this case, it is preferable that the pressure belt 10 be in contact with the fixing roller 1 during heating in order to shorten the heating time.

In contrast, when it is determined in Step S902 that the temperature of the pressure belt 10 is more than the first upper limit temperature T4, the pressure belt 10 is cooled during a standby state before an image forming job is started. That is, the pressure belt 10 is rotated without applying a current to the halogen lamp 18. In this case, the pressure belt 10 can be cooled by a cooling fan 17 provided near the pressure belt 10, as shown in FIG. 1, in order to shorten the cooling time. The on-off state of the cooling fan 17 is controlled by the print controller 311.

When the temperature of the pressure belt 10 becomes more than or equal to the first lower limit temperature T1 and less than or equal to the first upper limit temperature T4 because of heating or cooling in Step S904, an image forming job is immediately started in Step S905. More specifically, image formation on a recording material is started by the image forming section, and the pressure belt 10 is pressed against the fixing roller 1 in synchronization with the time when the recording material reaches the fixing nip.

As described above with reference to FIG. 8, when the image forming apparatus 100 is in a normal state, the temperature of the pressure belt 10 is more than or equal to the first lower limit temperature T1 and less than or equal to the first upper limit temperature T4. Therefore, the image forming job can be started without imposing a waiting time on the operator in the speed priority mode.

Sequence in Image-Quality Priority Mode

Figure 10:
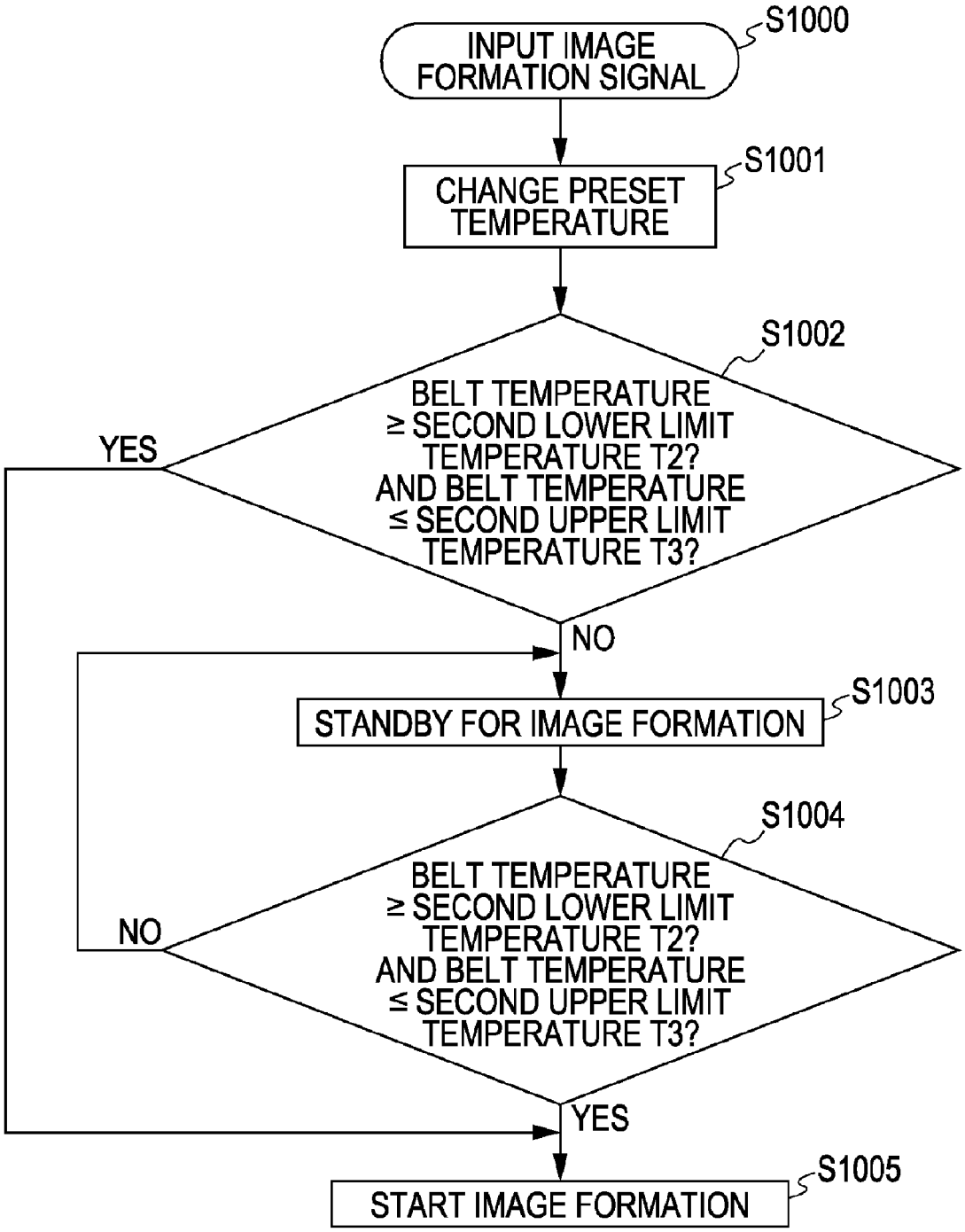
FIG. 10 is a flowchart showing an image forming sequence in an image-quality priority mode according to an embodiment.

A sequence in an image-quality priority mode for coated paper will now be described with reference to FIG. 10.

When an image formation signal (print command) is input in Step S1000, the preset temperatures of the fixing roller 1 and the pressure belt 10 are changed in Step S1001 in the same sequence as the above-described sequence shown in FIG. 6.

In Step S1002, it is determined whether the temperature of the pressure belt 10 is more than or equal to the second lower limit temperature T2 and less than or equal to the second upper limit temperature T3. That is, the output of the thermistor 8 for the pressure belt 10 is checked.

When it is determined in Step S1002 that the temperature of the pressure belt 10 is more than or equal to the second lower limit temperature T2 and less than or equal to the second upper limit temperature T3, image formation is started in Step S1005 immediately after the previous image forming job.

In contrast, when the temperature of the pressure belt 10 is not more than or equal to the second lower limit temperature T2 and less than or equal to the second upper limit temperature T3, the start of an image forming job is delayed (standby) in Step S1003.

When the temperature of the pressure belt 10 is more than the second upper limit temperature T3 in Step S1002, the pressure belt 10 is cooled during this standby state before the image forming job. That is, the pressure belt 10 is separated from the fixing roller 1, and is rotated without applying a current to the halogen lamp 18. In this case, the pressure belt 10 can be cooled by a cooling fan provided near the pressure belt 10 in order to shorten the cooling time.

In contrast, when the temperature of the pressure belt 10 is less than the second lower limit temperature T2 in Step S1002, the pressure belt 10 is heated during the standby state before an image forming job. That is, the pressure belt 10 is rotated while applying a current to the halogen lamp 18. In this case, it is preferable that the pressure belt 10 be in contact with the fixing roller 1 during heating in order to shorten the heating time.

Subsequently, when the temperature of the pressure belt 10 becomes more than or equal to the second lower limit temperature T2 and less than or equal to the second upper limit temperature T3 because of heating or cooling in Step S1004, an image forming job is immediately started in Step S1005.

When the temperature of the pressure belt 10 is still out of the second temperature range of T2 to T3 in Step S1004, Step S1003 is performed again to heat or cool the pressure belt 10.

As described above with reference to FIG. 8, even when the image forming apparatus 100 is in a normal state, the temperature of the pressure belt 10 can be lower than the second lower limit temperature T2 or more than the second upper limit temperature T3. Therefore, the image-quality priority mode can meet the operator's demand for higher image quality, although some waiting time is imposed on the operator.

A description will now be given of an image forming sequence performed in a case in which the type of the recording material used in the next image forming job is changed when a command to perform the next image forming job is input (requested) during the present forming job. More specifically, a case in which the next image forming job is set/selected in a speed priority mode and a case in which the next image forming job is set/selected in an image-quality priority mode will be described. In the previous image forming job, image formation is continuously performed on a plurality of sheets of plain paper.

Sequence Performed when the Next Image Forming Job is for Coated Paper

Figure 11:
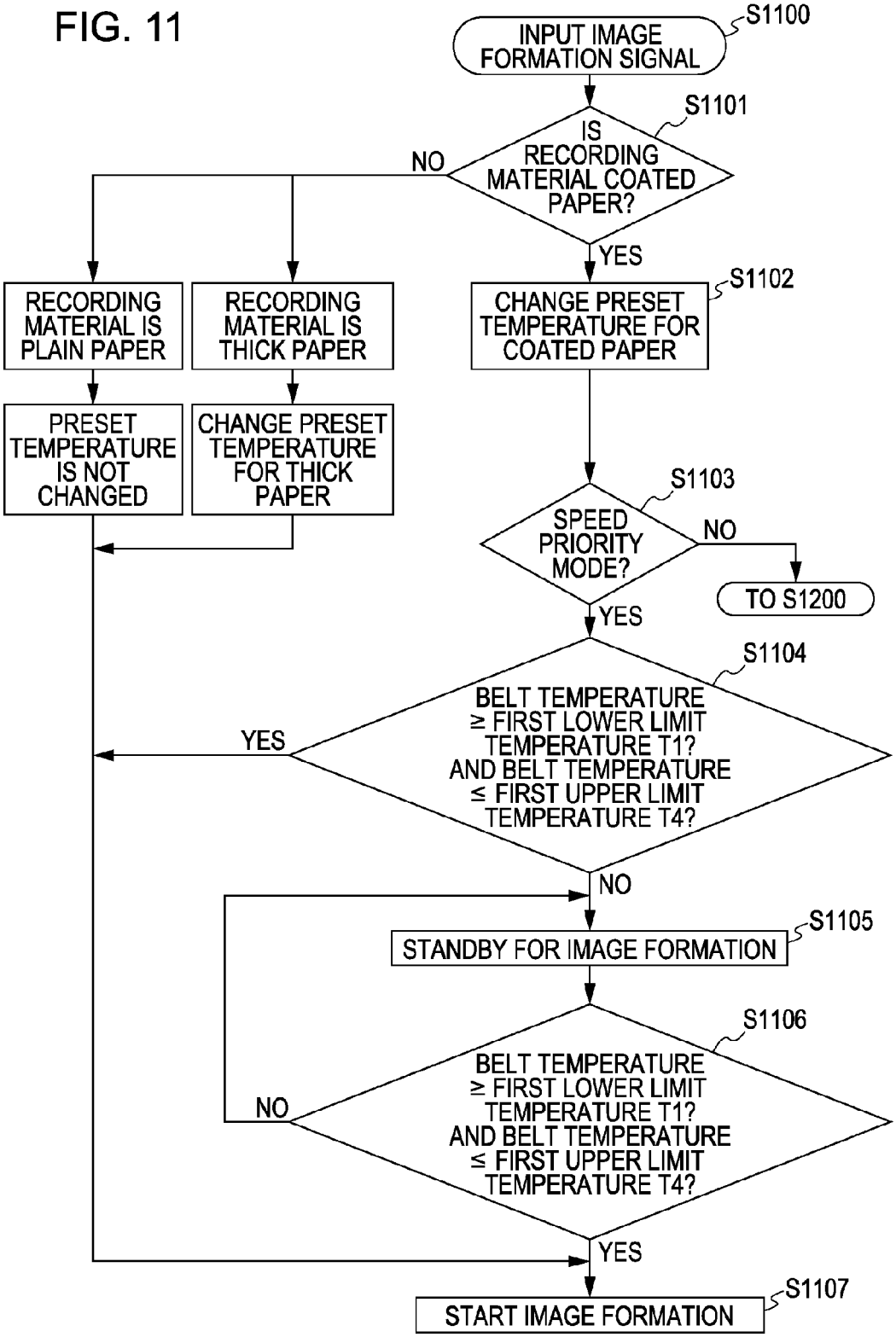
FIG. 11 is a flowchart showing an image forming sequence when switching is made to an image forming job on coated paper (set in a speed priority mode) according to an embodiment.

FIG. 11 shows a sequence performed when an image forming job for coated paper is requested while images are being continuously formed on a plurality of sheets of plain paper.

When an image formation signal (print command) for the next image forming job is input during a job for continuously forming images on sheets of plain paper in Step S1100, it is determined in Step S1101 whether the type of the recording material is changed.

In an embodiment, since the type of the recording material is changed from plain paper to coated paper, Step S1102 is performed. When plain paper is used in the next image forming job without changing the type of the recording material, the preset temperatures of the fixing roller 1 and the pressure belt 10 are not changed, and the next image forming job is started in Step S1107 immediately after the previous image forming job. When the recording material used in the next image forming job is changed to thick paper, the preset temperatures of the fixing roller 1 and the pressure belt 10 are changed, and the next image forming job is started in Step S1107 immediately after the previous image forming job.

In Step S1102, the preset temperatures of the fixing roller 1 and the pressure belt 10 are changed in accordance with coated paper in the same sequence as the above-described sequence shown in FIG. 6.

In Step S1103, it is determined whether the next image forming job is selected/set in a speed priority mode or an image-quality priority mode.

Figure 9:
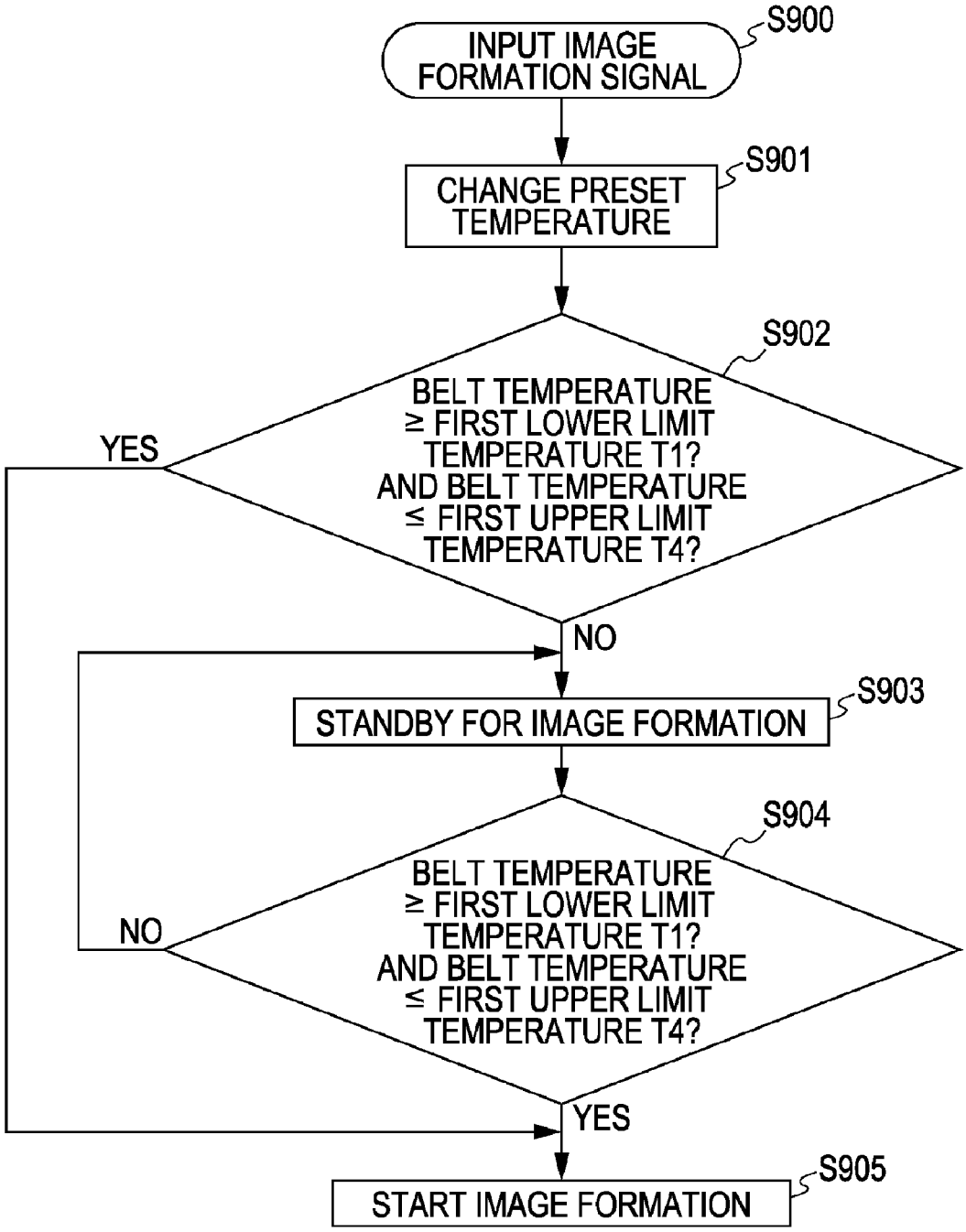
FIG. 9 is a flowchart showing an image forming sequence in a speed priority mode according to an embodiment.

When the next image forming job is set in a speed priority mode in Step 1103, Steps S1104 to S1107 are performed in the same sequence as the above-described sequence shown in FIG. 9.

Figure 12:
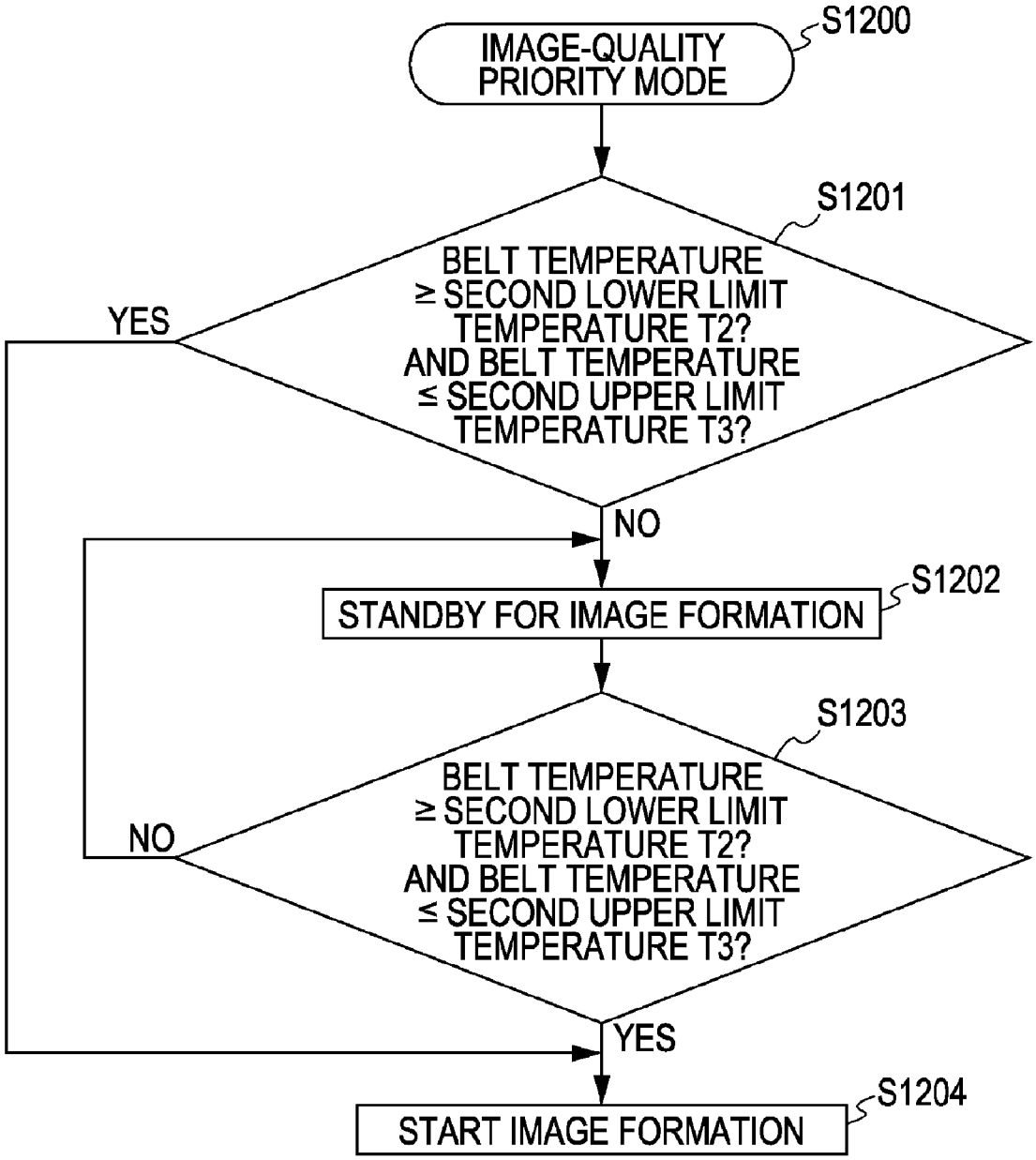
FIG. 12 is a flowchart showing an image forming sequence when switching is made to an image forming job on coated paper (set in an image-quality priority mode) according to an embodiment.

When the next image forming job is set in an image-quality priority mode in Step S1103, Step S1200 in FIG. 12 is performed.

FIG. 12 shows a sequence performed after it is determined that the next image forming job is set in an image-quality priority mode.

When it is determined in Step S1103 in FIG. 11 that the next image forming job is set in an image-quality priority mode, it is determined in Step S1201 whether the temperature of the pressure belt 10 is more than or equal to the second lower limit temperature T2 and less than or equal to the second upper limit temperature T3. Step S1201 and subsequent steps are performed as in the sequence described above with reference to FIG. 10.

While image formation is performed on recording materials of the same type in each image forming job in the above-described embodiment, the present invention is also applicable to the following case.

For example, the above-described sequences can also be performed in a job for continuously forming images on a plurality of types of recording materials. That is, the present invention is preferably applied to a case in which the type of the recording sheet is changed from plain paper to coated paper in one image forming job for continuously forming images on ten sheets of plain paper and two sheets of coated paper. More specifically, when the image forming job for coated paper is set in a speed priority mode, it is started without delaying the start of the job. In contrast, when the image forming job is set in an image-quality priority mode, it is started after the temperature of the pressure belt 10 reaches the above-described temperature range. In this case, when the temperature of the pressure belt 10 is within the above-described temperature range, image formation is started immediately.

According to the above-described embodiments, it is possible to provide an image forming apparatus that can meet various demands of the operator when image formation is performed on coated paper.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-189245 filed Jul. 10, 2006, which is hereby incorporated by reference herein in its entirety.

What is claimed is:

1. An image forming apparatus comprising:

an image forming device configured to form a toner image on a plurality of types of recording materials including coated paper whose surface is coated with resin;

an image heating device configured to heat the toner image on the recording material at a nip portion;

a detector configured to detect a temperature of the image heating device;

an operating panel which is operable by an operator, in a case where the type of recording material is the coated paper, so as to set one of at least two image forming modes for the recording material, the at least two image forming modes including a first image forming mode in which the recording material is conveyed at a first speed and an image is formed on the recording material and a second image forming mode in which the recording material is conveyed at a second speed slower than the first speed and an image is formed on the recording material; and a controller configured to control the image forming device in accordance with the image forming mode set via the operating panel, wherein the controller permits start of image formation in accordance with the temperature detected by the detector, and wherein image formation in the first image forming mode is started when the temperature is within a first temperature range which is between a first temperature and a second temperature and image formation in the second image forming mode is started when the temperature is within a second temperature range which is within the first temperature range.

2. The image forming apparatus according to claim 1, wherein, when the temperature of the image heating device is not within the second temperature range in the second image forming mode, the controller delays the start of image formation until the temperature of the image heating device becomes within the second temperature range.

3. The image forming apparatus according to claim 2, wherein the image heating device comprises:

a heating rotary member configured to heat the toner image on the recording material by contacting with the toner image at the nip portion; and an endless belt configured to form the nip portion with the heating rotary member therebetween, wherein the detector detects a temperature of the belt, and the controller permits the start of image formation in accordance with the temperature of the belt.

4. The image forming apparatus according to claim 1, wherein the controller permits start of image formation in accordance with the temperature detected by the detector, and wherein image formation in the first image forming mode is started when the temperature is not lower than a first lower limit temperature, and image formation in the second image forming mode is started when the temperature is not lower than a second lower limit temperature which is higher than the first lower limit temperature.

5. The image forming apparatus according to claim 4, wherein, when the temperature of the image heating device is lower than the second lower limit temperature in the second image forming mode, the controller delays the start of image formation until the temperature of the image heating device becomes equal to the second lower limit temperature.

6. The image forming apparatus according to claim 5, wherein the image heating device comprises:

a heating rotary member configured to heat the toner image on the recording material by contacting with the toner image at the nip portion; and an endless belt configured to form the nip portion with the heating rotary member therebetween, wherein the detector detects a temperature of the belt, and the controller permits the start of image formation in accordance with the temperature of the belt.

7. The image forming apparatus according to claim 1, wherein the controller permits the start of image formation in accordance with the temperature detected by the detector, and wherein image formation in the first image forming mode is started when the temperature is not higher than a first upper limit temperature, and image formation in the second image forming mode is started when the temperature is not higher than a second upper limit temperature which is lower than the first upper limit temperature.

8. The image forming apparatus according to claim 7, wherein, when the temperature of the image heating device is higher than the second upper limit temperature in the second image forming mode, the controller delays the start of image formation until the temperature of the image heating device becomes equal to the second upper limit temperature.

9. The image forming apparatus according to claim 8, wherein the image heating device comprises:

a heating rotary member configured to heat the toner image on the recording material by contacting with the toner image at the nip portion; and an endless belt configured to form the nip portion with said heat rotation member therebetween, wherein the detector detects a temperature of the belt, and the controller permits the start of image formation in accordance with the temperature of the belt.

* * * * *